United States Patent [19]

Scofield

[11] Patent Number: 4,890,677

[45] Date of Patent: Jan. 2, 1990

[54] CHECK VALVE SYSTEM FOR FIRE EXTINGUISHER

[75] Inventor: William A. Scofield, Clifton, N.J.

[73] Assignee: Pem All Fire Extinguisher Corporation, Cranford, N.J.

[21] Appl. No.: 235,658

[22] Filed: Aug. 24, 1988

[51] Int. Cl.[4] ..... A62C 23/10

[52] U.S. Cl. ..... 169/75; 169/74

[58] Field of Search ..... 169/74, 75

[56] References Cited

U.S. PATENT DOCUMENTS 4,019,584 4/1977 Allmendinger ..... 169/74

4,779,683 10/1988 Enk ..... 169/75

FOREIGN PATENT DOCUMENTS 472162 6/1971 Italy ..... 169/31

*Primary Examiner*—Joseph F. Peters, Jr.

*Assistant Examiner*—Anne Sartelle

*Attorney, Agent, or Firm*—Rohm & Monsanto

[57] ABSTRACT

A check system for a chemical fire extinguisher utilizes a normally-closed check valve to prevent escape of pressurized chemical during periodic maintenance of a pressure monitoring system, such as a pressure gauge. An actuator member which is disposed within the flow channel of the fire extinguisher system is used to apply a force to the check system whereby a normally-closed check valve is urged to its open state. This open state establishes communication between the interior of the pressurized tank and the pressure monitoring system. Removal, or loosening, of a coupler, or union, which secures the pressure monitoring system to the chemical tank, permits the check valve to return to its normally-closed state. Thus, the pressure monitoring system can be removed and serviced periodically without requiring the pressurized tank to be emptied.

15 Claims, 2 Drawing Sheets

CHECK VALVE SYSTEM FOR FIRE EXTINGUISHER

BACKGROUND OF THE INVENTION

This invention relates generally to fire extinguisher systems, and more particularly, to a check valve arrangement for facilitating periodic maintenance of the pressure monitoring and actuation systems in a chemical fire extinguisher system.

Pressurized chemical fire extinguisher systems generally are triggered into operation by release of pressure on an ambient side of a piston valve. This action results in displacement of the piston valve in response to the pressure in the chemical storage tank, and subsequent opening of the piston valve. The piston valve remains in the closed state as long as the ambient side remains sealed, whereby the pressure on both sides of the piston is equalized. The ambient side pressure is reduced by venting the ambient side of the piston to the atmosphere.

Venting of the piston valve may be achieved by any of several known arrangements. One known arrangement is a manually actuated valve which opens to the atmosphere upon manipulation of a control member. Alternatively, venting may be achieved by an electric valve or a pneumatic operator. In certain systems, such opening is responsive to excessive heat in the region which is desired to be protected.

In most presently known pressurized chemical fire extinguisher systems, it is extremely important that the pressure in the chemical reservoir, or tank, be monitored, as even slow leakage will eventually render the fire extinguisher system unusable and unsafe. For this reason, the tank is provided with a pressure gauge, which will provide a visual indication of the pressure in the system.

It is a problem with visual indicator gauges that after they have been exposed to a constant pressure for a considerable length of time, as is the case with fire extinguisher systems, a mechanical indicator therein may become fixed in its position, and remain indicating falsely that the fire extinguisher system is in an operational state, even though leakage may have reduced the tank pressure to an unacceptably low level. Additionally, the pressure gauge might be damaged by accidentally being struck with an object, requiring replacement or repair of the gauge. It therefore is highly desirable to service the pressure indicator periodically, and ascertain whether it is operative.

The manual operator, the electric solenoid operator, the electric low cylinder pressure switch, and the pneumatic operator are all subject to cylinder pressure and require servicing to ascertain they are all operating as intended. In the present state of the art, these assemblies cannot be checked for operation while they are subjected to cylinder pressure. It would be desirable, however, to service these assemblies without requiring depressurization, or discharge, of the cylinder. In addition to the cost and time involved in the servicing of the pressure indicator, the system is not functional during such maintenance, leaving the premises unprotected unless a replacement chemical tank is made available during servicing.

It is, therefore, an object of this invention to provide a simple and economical arrangement for facilitating periodic maintenance of a chemical fire extinguisher system.

It is another object of this invention to provide a system for providing maintenance to the pressure monitoring system of a chemical fire extinguisher without disabling the system even temporarily.

It is also an object of this invention to provide a simple apparatus for facilitating removal and replacement of a pressure gauge, electric solenoid, low cylinder pressure switch, and manual and pneumatic operators.

It is a further object of this invention to provide a safety arrangement for a chemical fire extinguisher whereby removal of a safety nut for gaining access to the pressure monitoring system of the fire extinguisher will cause discontinuation of the communication between the pressure monitoring system and the pressurized chemical.

It is additionally an object of this invention to provide a safety-check system for a fire extinguisher which is modular in construction, whereby individual components thereof are easily replaceable.

It is yet a further object of this invention to provide a system which simplifies, and reduces the cost of, servicing a chemical fire extinguisher system.

SUMMARY OF THE INVENTION

The foregoing and other objects are achieved by this invention which provides, in a chemical fire extinguisher system, a chemical flow check system for facilitating periodic maintenance. In accordance with the invention, the chemical flow check system is provided with a check valve arrangement having selectably open and closed states, and having associated therewith a resilient biasing element for urging flow control surfaces of the check valve arrangement into communication with one another, whereby the check valve arrangement is urged in the direction of the closed state. In this specific illustrative embodiment of the invention, a carrier element is arranged to have a first chemical flow channel therein. The first chemical flow channel is adapted to engage sealingly with the check valve arrangement for controlling chemical flow through the first chemical flow channel in response to the selectably open and closed states of the check valve arrangement. An actuator, having a check valve engagement portion, is arranged to be in communication with the first chemical flow channel of the carrier element for actuating the check valve arrangement. The actuator is further arranged to have a second chemical flow channel therein which communicates with the first chemical flow channel. A coupler member couples the carrier element and the actuator in a predetermined orientation with respect to one another whereby the actuator is adapted to travel between first and second positions, the first and second positions corresponding to open and closed states, respectively, of the check valve arrangement.

In one embodiment of the invention, the actuator is arranged at least partially in the chemical flow channel of the carrier element. A coupling portion of the actuator, however, and the second chemical flow channel, are arranged in this embodiment to extend outward of the coupler member. In a preferred embodiment, the first and second chemical flow channels are oriented to be substantially coaxial with to one another, and the travel of the actuator between the first and second positions is in directions substantially parallel with respect to the first and second chemical flow channels.

In a further embodiment of the invention, there is additionally provided a distribution arrangement for forming at least one chemical flow subchannel adapted for engaging with a chemical pressure monitoring device. The coupling portion of the actuator is provided with a threaded engagement portion for engaging with the distribution arrangement.

A displacement member is provided for displacing the distribution arrangement along a predetermined path and thereby urging the actuator to the second position. This actuates the check valve arrangement into the open state. In a specific embodiment, the displacement member is threaded for communicating with, and maintaining displaced, the distribution arrangement whereby the actuator is maintained in the second position.

In accordance with a further aspect of the invention, a flow check system is provided for facilitating maintenance of a pressure monitoring gauge, electric solenoid, pressure switch, and pneumatic operators of a fire extinguisher system of the type which contains a pressurized chemical; the pressure monitoring gauge being of the type having a pressure-sensitive element. In a specific illustrative embodiment of this aspect of the invention, a distribution arrangement is provided with a distribution channel for conducting the pressurized chemical. The distribution arrangement is adapted for engaging couplingly with the pressure monitoring gauge, electric solenoid, pressure switch, and pneumatic operators, whereby the pressure-sensitive element of the pressure monitoring gauge communicates with the distribution channel. A flow check arrangement having a supply channel for conducting the pressurized chemical, has a normally-closed state for impeding flow of the pressurized chemical through the supply channel, and an open state, which are selectable in response to the displacement of an actuator portion of the flow check arrangement. The actuator portion is in communication with the distribution arrangement. A bias member is provided for displacing the distribution arrangement with respect to the actuator portion of the flow check arrangement, whereby the flow check arrangement is urged to the open state.

In a preferred embodiment of the invention, the flow check arrangement includes a check valve, which may be of the type which has a resilient member associated therewith for resiliently urging the check valve toward a closed state. There further is provided in certain embodiments a coupler member mechanically interposed between the distribution arrangement and the actuator portion of the flow check arrangement, for displacing the actuator portion in response to displacement of the distribution arrangement in response to the urging of the bias member. The coupler member is provided with a threaded portion for threadedly engaging with the distribution arrangement, and with a coupling channel for communicating at a first end thereof with the supply channel of the flow check arrangement, and at a second end thereof with the distribution channel of the distribution arrangement.

In one highly advantageous embodiment of the invention there is provided a union for displaceably joining the coupler member with the flow check arrangement. The union is arranged to have a threaded portion for threadedly engaging with the flow check arrangement. Preferably, the threaded portion of the coupler member extends outward of the union to facilitate both, the coupling and the displacement of the coupler member. The coupler portion is provided with an actuator engagement portion arranged at one end thereof for communicating with the actuator portion of the flow check arrangement. This facilitates selection between the normally-closed and open states. Preferably, the actuator portion is adapted to have a wrench applied thereto for facilitating the threaded engagement of the coupler portion with the distribution arrangement. In such an embodiment, the actuator portion is disposed within the union.

The present invention provides the significant advantage of simplifying and reducing the cost of servicing the pressure monitoring system of a chemical fire extinguisher. Moreover, the present check valve arrangement furthers safety by obviating the need to empty the pressurized chemical tank or otherwise disable the fire extinguisher system, even temporarily during maintenance. Pressure loss is prevented in the event that a safety cap is accidentally loosened. Moreover, the present invention serves to reduce the possibility of injury to service personnel during periodic maintenance of the pressure monitoring system. The check valve system of the present invention is itself easily removable from the pressurized chemical tank.

BRIEF DESCRIPTION OF THE DRAWING

Comprehension of the invention is facilitated by reading the following detailed description, in conjunction with the annexed drawing, in which.

DETAILED DESCRIPTION

Figure 1:
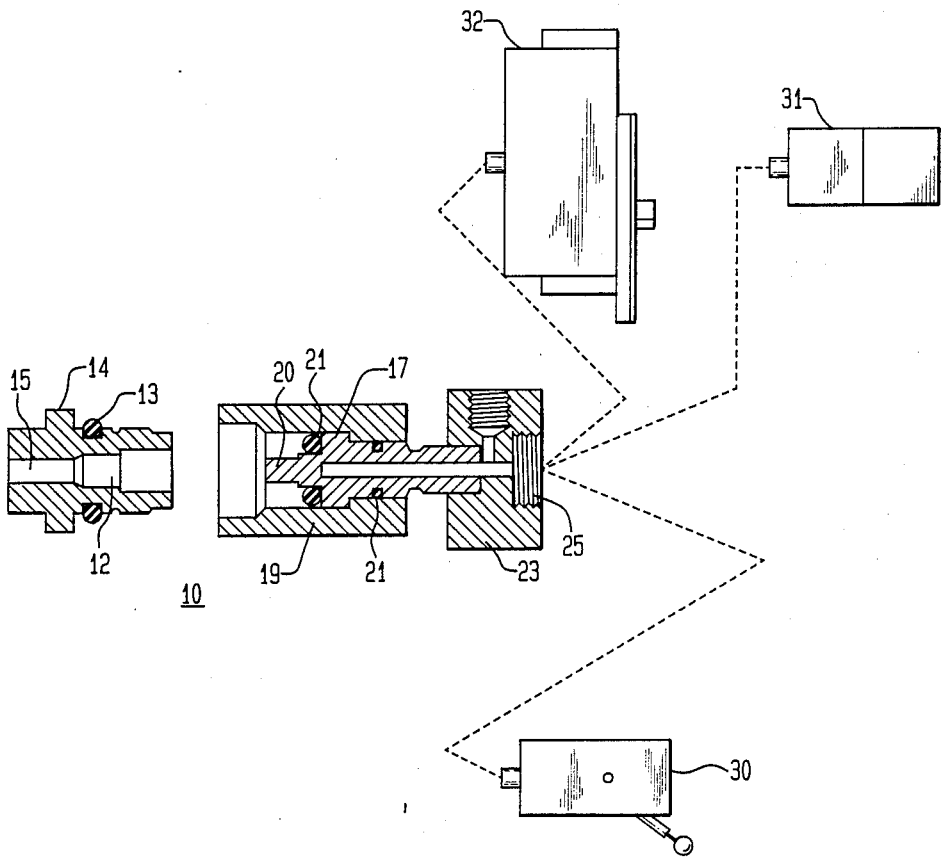
FIG. 1 is a plan cross-sectional representation of one embodiment of the invention.

FIG. 1 is a plan cross-sectional representation of a specific illustrative embodiment of a chemical flow check system 10 for use in a pressurized chemical fire extinguisher system (not shown). In accordance with the invention, chemical flow check system 10 is provided with a check valve arrangement 12 which is schematically shown to be disposed within a carrier element 14. Check valve arrangement 12 is of the type which is provided with a resilient member (not specifically shown) which is biased toward a normally closed position. In a closed state, the check valve arrangement prevents passage of the chemical flow through chemical flow channel 15 of the carrier element.

Carrier element 14 is joined to an actuator 17 by a coupler member 19. A resilient O-ring seal 1 maintains a leak proof coupling between the carrier element and the coupler member. In this specific embodiment, coupler member 19 operates as a union which joins threadedly with the carrier element. Actuator 17, which is at least partially disposed within coupler member 19, has provided therewith an actuator portion 20 which communicates with check valve arrangement 12. After the carrier element is threadedly engaged with coupler member 19, actuator 17 is displaceable axially therewithin. During such displacement, a seal is maintained between the actuator and the coupler member by operation of O-rings 17 and 21.

In the representation of FIG. 1, actuator 17 is displaceable for a limited distance to the left, and in so doing, actuator portion 20 communicates with check valve arrangement 12 whereby check valve arrangement 12 enters an open state. The open state permits the fire extinguisher chemical (not shown) to flow through chemical flow channel 15 and to a distribution member 23. The resilient member of the check valve arrangement urges actuator 17, and distribution member 23 installed thereon, toward the right whereby the normally-closed state is maintained. However, the application of a force onto distribution member 23 toward the left will overcome the bias force applied by the resilient member, and therefore the check valve arrangement is opened.

In this specific illustrative embodiment, distribution member 23 is provided with an axial threaded opening 25 which can accommodate any of a plurality of control devices. For example, such a device may include a manually operated arrangement 30 or a pneumatically operated arrangement 31. In certain embodiments, a heat actuated device 32 may be employed. During operation of the invention in a fire extinguisher system (not shown) in a quiescent state (ready mode), the internal volume (not specifically shown), such as that within axial threaded opening 25, is pressurized to a substantially static pressure level with the chemical (not shown). As such, this internal volume can be considered as a pressure chamber, which upon being vented by actuation of one of the control devices, will activate the fire extinguisher system. Thus, these control devices serve to trigger the fire extinguisher in the conventional manner. As is evident from this figure, the control devices can be serviced without requiring a pressurized chemical reservoir (not shown), which would be connected to carrier element 14, to be emptied. As coupler member 19, with distribution member 23 and the control devices attached thereto, is removed from engagement with the carrier element, actuator portion 20 is disengaged from check valve arrangement 12, whereby the check valve arrangement is permitted to assume its normally closed position, as described hereinabove.

Figure 2:
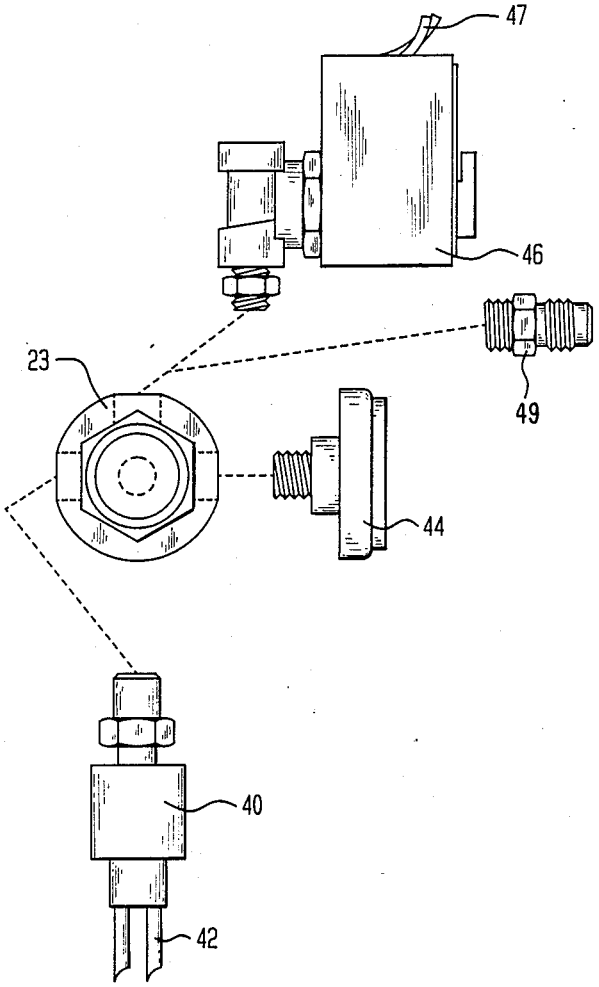
FIG. 2 is a partially phantomed representation of a pressure distribution arrangement used in the embodiment of FIG. 1.

FIG. 2 is a plan view of a specific, illustrative distribution member 23 shown in FIG. 1. As shown in FIG. 2, the distribution member has provided three radial threaded apertures for receiving various devices. Such devices include a pressure operated switch 40 which provides a predetermined electrical state at output leads 42 in response to pressure, a monitor gauge 44 for producing a visual indication of the pressure, and a solenoid actuator 46 which operates the fire extinguisher in response to an electrical signal at input leads 47. In embodiments of the invention where solenoid actuator 46 is not used, a check calve 49 may be used instead.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. In a chemical fire extinguisher system, a chemical flow check system comprising:

check valve means having selectably open and closed states, said check valve means having associated therewith a resilient biasing element for urging flow control surfaces of said check valve means into communication with one another, whereby said check valve means is urged in the direction of said closed state;

carrier means having a first chemical flow channel therein, said first chemical flow channel being adapted to engage sealingly with said check valve means for controlling chemical flow through said first chemical flow channel in response to said selectably open and closed states of said check valve means;

actuator means having a check valve engagement portion arranged to be in communication with said first chemical flow channel of said carrier means for actuating said check valve means, said actuator means further having a second chemical flow channel therein and arranged to communicate with said first chemical flow channel;

coupler means for removably coupling said carrier means and said actuator means in a predetermined orientation with respect to one another whereby, when said coupler means is completely coupled with said carrier means, said actuator means is in an engaged relationship with said check valve means, and as said coupler means is uncoupled from said carrier means, said actuator means assumes a disengaged relationship with said check valve means, said engaged and disengaged relationships corresponding to open and closed states, respectively, of said check valve means;

pressure chamber means coupled to said coupler means and arranged to be in fluid communication with said second chemical flow channel of said actuator means, for receiving at least a portion of said chemical flow through said first and second chemical flow channels when said check valve means is in said open state; and control valve means arranged in fluid communication with said pressure chamber means, said control valve means having a closed state for permitting a static pressure to be retained in said pressure chamber means, and an open state for venting said pressure in said pressure chamber means.

2. The chemical flow check system of claim 1 wherein said actuator means is arranged at least partially in said chemical flow channel of said carrier means.

3. The chemical flow check system of claim 1 wherein a coupling portion of said actuator means, and said second chemical flow channel, extend outward of said coupler means.

4. The chemical flow check system of claim 3 wherein said first and second chemical flow channels are arranged substantially coaxially with respect to one another, and said travel of said actuator means between said first and second positions is in directions substantially parallel with respect to said first and second chemical flow channels.

5. The chemical flow check system of claim 3 wherein there is further provided distribution means for forming at least one chemical flow subchannel adapted for engaging with a chemical pressure monitoring device.

6. The chemical flow check system of claim 5 wherein said coupling portion of said actuator means is provided with threaded engagement means for engaging with said distribution means.

7. The chemical flow check system of claim 6 wherein there is further provided displacement means for displacing said distribution means for urging said actuator means to said second position and actuating said check valve means into said open state.

8. The chemical flow check system of claim 7 wherein said displacement means comprises threaded displacement means for communicating with, and maintaining displaced, said distribution means whereby said actuator means is maintained in said second position.

9. A flow check system for facilitating maintenance of a pressure monitoring gauge of a fire extinguisher system of the type which contains a pressurized chemical in a reservoir, the pressure monitoring gauge having a pressure-sensitive element, the flow check system comprising:

distribution means having a distribution channel for conducting the pressurized chemical, said distribution means being adapted for engaging couplingly with the pressure monitoring gauge, whereby the pressure-sensitive element of the pressure monitoring gauge communicates with said distribution channel;

flow check means having a supply channel for conducting the pressurized chemical from the reservoir, said flow check means having a normally-closed state for impeding flow of the pressurized chemical through said supply channel, and an open state, said normally-closed and open states being responsive to a location of an actuator portion of said flow check means, said actuator portion being selectably in communication with said distribution means;

bias means for displacing said distribution means with respect to said actuator portion of said flow check means, whereby said flow check means is urged to said open state; and control valve means having open and closed states, and arranged to communicate with said distribution means, said control valve means being in a closed state when the fire extinguisher system is in a quiescent state, and further being selectably openable for venting said distribution means and thereby activating the fire extinguisher system.

10. The flow check system of claim 9 wherein said flow check means comprises a check valve having a resilient member associated therewith for resiliently urging said check valve toward a closed state.

11. The flow check system of claim 10 wherein there is further provided coupler means mechanically interposed between said distribution means and said actuator portion of said flow check means, for displacing said actuator portion in response to displacement of said distribution means in response to said bias means.

12. The flow check system of claim 11 wherein said coupler means is provided with a threaded portion for threadedly engaging with said distribution means.

13. The flow check system of claim 11 wherein said coupler means is provided with a coupling channel for communicating at a first end thereof with said supply channel of said flow check means, and at a second end thereof with said distribution channel of said distribution means.

14. The flow check system of claim 11 wherein there is further provided union means for displaceably joining said coupler means with said flow check means, said union means having a threaded portion for threadedly engaging with said flow check means, said threaded portion of said coupler means extending outward of said union means.

15. The flow check system of claim 14 wherein said coupler portion is provided with an actuator engagement portion arranged at one end thereof for communicating with said actuator portion of said flow check means, said actuator portion further being adapted for having a wrench removably applied thereto for facilitating said threaded engagement of said coupler portion with said distribution means, said actuator portion being disposed within said union means.

* * * * *